United States Patent [19]

Hoije

[11] 4,184,928

[45] Jan. 22, 1980

[54] METHOD OF PREPARING A STEEL SURFACE FOR PAINTING OR ENAMELLING

[75] Inventor: Hugo Hoije, Kallered, Sweden

[73] Assignee: HH-Produkter, Magnusson & Co., Kallered, Sweden

[21] Appl. No.: 938,023

[22] Filed: Aug. 30, 1978

[30] Foreign Application Priority Data

Sep. 15, 1977 [SE] Sweden ..... 7710315

[51] Int. Cl.[2] ..... C25D 3/56; C25D 3/60; C25D 5/02; C25D 5/06

[52] U.S. Cl. ..... 204/43 Z; 204/15; 204/43 S

[58] Field of Search ..... 204/43 Z, 43 S, 123, 204/15

[56] References Cited

U.S. PATENT DOCUMENTS

| | | | |
|---|---|---|---|
| 2,898,274 | 8/1959 | Saubestre et al. | 204/43 Z |
| 4,049,481 | 9/1977 | Morisaki | 204/43 Z X |

FOREIGN PATENT DOCUMENTS

| | | | |
|---|---|---|---|
| 51-75633 | 6/1976 | Japan | 204/43 Z |
| 159082 | of 1963 | U.S.S.R. | 204/43 Z |

*Primary Examiner*—G. L. Kaplan

[57] ABSTRACT

A method of preparing a steel surface for painting or enamelling in which the surface is coated with a tin-zinc alloy by electrodeposition from an aqueous electrolyte containing zinc sulphamate, tin sulphate and sulphamic acid.

3 Claims, No Drawings

METHOD OF PREPARING A STEEL SURFACE FOR PAINTING OR ENAMELLING

The invention relates to a method of preparing a steel surface for painting or enamelling. The invention also relates to an electrolyte for electrodepositing a metallic coating on a steel surface preparatory to painting or enamelling said surface.

It is a recognized fact that the adherence, as well as other properties, of a coating of paint or enamel on steel sheets and other steel workpieces are strongly dependent on the state of the surface on which the paint or enamel is applied. If the paint or enamel is applied to an untreated steel surface, the adherence of the paint or enamel to the steel may be unsatisfactory. Also, the protection of the steel against corrosion may be inadequate, particularly when the coating consists of a thin layer of an air-drying enamel or lacquer.

Zinc coating (by electrolytic deposition or hot dipping) prior to painting or enamelling provides a good protection against corrosion, but the adhesion of the paint or enamel to the zinc coating will not be satisfactory unless the zinc coating is submitted to an aging process prior to the application of the paint or enamel. Other known methods involve electrolytic treatment of the steel with strongly alkaline electrolytes containing cyanides, or with strongly acid electrolytes which generally contain sulphuric acid. As the electrolytes are poisonous and/or strongly corrosive, they have to be handled with great precautions and are not suitable for use outside properly equipped premises. Also, they are not suitable for repairing minor damages in an enamel coating, for instance of a car, as the region of the coating surrounding the damaged spot may be harmed by the electrolyte.

It is an object of the present invention to provide an improved method of treating a steel surface which imparts to said surface the property of providing a strong adhesive bond with a coating of paint or enamel subsequently applied on said surface. Another object is to provide an electrolyte for the pre-treatment of a steel surface which is not poisonous and not, or only slightly, corrosive and can be used safely by unqualified persons.

The method according to the invention is distinguished substantially thereby that it comprises the step of coating the steel surface with a tin-zinc-alloy by electro-deposition from an aqueous electrolyte containing zinc sulphamate, tin sulphate and sulphamic acid. Accordingly, the new electrolyte according to the invention is distinguished substantially thereby that it consists of an aqueous solution containing zinc sulphamate, tin sulphate and sulphamic acid.

The ratio of the contents (by weight) of tin and zinc present in the solution should preferably amount to not less than 20:80 and not more than 60:40. At Sn:Zn ratios below 20:80, the adhesion of the coating of paint or enamel to the treated area will not be satisfactory. Ratios above 60:40 render the electrolyte chemically unstable, the divalent tin tending to be oxidized into quadrivalent tin which is precipitated.

In the following preferred example of an electrolyte according to the invention, the contents by weight of the tin and the zinc are in a ratio of about 35:65:

Zinc sulphamate—100 grams
Tin sulphate—25 grams
Sulphamic acid—120 grams
Malic acid—50 grams
Water—1 liter With this solution (as specified, or diluted with more water), excellent results have been obtained in brush plating of steel sheet with an operating voltage of 10 to 15 volts. Brush plating is a well known method carried out by means of a brush having bristles of an electrically nonconducting material, for instance nylon, set in a brush head provided with an electrode connected to the positive pole of a source of current, while the work to be plated is connected to the negative pole of the source of current. The brush is moistened with the electrolyte and moved repeatedly across the surface to be coated. With the electrolyte composed according to the invention, this method has proved eminently suitable for the treatment of damaged spots in the enamel coating of cars. As usual, the area to be treated has to be thoroughly cleaned by grinding before being subjected to the electroplating treatment. The process can be carried out by any car owner with a minimum of instruction. The current can be provided by the normal 12 volts car battery. The solution does no harm to the parts of the enamel coating of the car with which it may come into contact and is nonpoisonous and only slightly corrosive.

The malic acid specified in the above Example is no necessary constituent of the electrolyte according to the invention but has the favourable effect of suppressing the oxidization of the tin ions which may otherwise occur during the coating process.

Extensive tests in which pieces of steel sheet have been coated with a tin-zinc alloy applied according to the invention and subsequently painted or enamelled have demonstrated a superior adhesion between the paint or enamel and the metal as well as an improved resistance to rusting.

I claim:

1. A method of preparing a steel surface for painting or enamelling which comprises the step of coating the surface with a tin-zinc alloy by electrodeposition from an aqueous electrolyte containing zinc sulphamate, tin sulphate and sulphamic acid, the proportion of tin sulphate to zinc sulphate being such as to provide a weight ratio of not less than 20:80 and not more than 60:40 between the tin and the zinc present in the solution.

2. An electrolyte for electrodepositing a metallic coating on a steel surface preparatory to painting or enamelling said surface, comprising of an aqueous solution containing zinc sulphamate, tin sulphate and sulphamic acid, the weight ratio of the contents of tin and zinc of the solution amounting to not less than 20:80 and not more than 60:40.

3. An electrolyte as claimed in claim 2 which additionally contains malic acid.

* * * * *